US007414373B2

(12) United States Patent
Cho et al.

(10) Patent No.: US 7,414,373 B2
(45) Date of Patent: Aug. 19, 2008

(54) DISCHARGE LAMP DRIVING CIRCUIT AND METHOD OF DRIVING A DISCHARGE LAMP

(75) Inventors: Gyu-Hyeong Cho, Daejeon (KR); Sang-Kyung Kim, Daejeon (KR); Hee-Seok Han, Daejeon (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/760,062

(22) Filed: Jun. 8, 2007

(65) Prior Publication Data

US 2007/0229002 A1 Oct. 4, 2007

Related U.S. Application Data

(62) Division of application No. 11/232,316, filed on Sep. 21, 2005, now Pat. No. 7,242,155.

(30) Foreign Application Priority Data

Sep. 22, 2004 (KR) ..... 2004-75743

(51) Int. Cl.
*G05F 1/00* (2006.01)

(52) U.S. Cl. ..... 315/307; 315/291; 315/209 CD; 315/224; 315/247

(58) Field of Classification Search ..... 315/291, 315/224, 225, 307–311, 297, 209 R, 209 CD
See application file for complete search history.

(56) References Cited

U.S. PATENT DOCUMENTS

| | | | |
|---|---|---|---|
| 6,163,115 | A | 12/2000 | Ishizuka |
| 7,187,137 | B2 | 3/2007 | Yadlapalli |
| 7,221,107 | B2 | 5/2007 | Melis |
| 2003/0160573 | A1 | 8/2003 | Johnson |
| 2004/0113567 | A1 | 6/2004 | Yamauchi et al. |
| 2004/0189216 | A1 | 9/2004 | Choi |

FOREIGN PATENT DOCUMENTS

| | | | |
|---|---|---|---|
| JP | 2004-119206 | A | 4/2004 |
| KR | 1020030087308 | A | 11/2003 |
| KR | 1020040018658 | A | 3/2004 |

*Primary Examiner*—Tuyet Vo
(74) *Attorney, Agent, or Firm*—Myers Bigel Sibley & Sajovec

(57) ABSTRACT

A discharge lamp driving circuit includes an inverter, a ballast capacitor, a discharge lamp, and a lamp current detecting circuit. The inverter converts a DC voltage into an AC voltage with high frequency to output the AC voltage to an output port based on a pulse width modulation control signal. The lamp current detecting circuit outputs a first voltage signal and a second voltage signal according to a voltage across the ballast capacitor to generate a lamp current sensing voltage that is proportional to a lamp current flowing through the discharge lamp. The pulse width modulation control signal has a width varying with amplitude of the lamp current so that the lamp current may be accurately detected.

21 Claims, 8 Drawing Sheets

DISCHARGE LAMP DRIVING CIRCUIT AND METHOD OF DRIVING A DISCHARGE LAMP

CROSS-REFERENCE TO PRIORITY APPLICATION AND RELATED APPLICATION

This application is a divisional of U.S. application Ser. No. 11/232,316, filed Sep. 21, 2005 now U.S. Pat. No. 7,242,155, which claims priority to Korean Application No. 2004-75743, filed Sep. 22, 2004. The disclosure of U.S. application Ser. No. 11/232,316 is hereby incorporated herein by reference. This application is also related to U.S. application Ser. No. 11/760,071, filed concurrently herewith, entitled Discharge Lamp Driving Circuit Having A Signal Detection Circuit Therein.

FIELD OF THE INVENTION

The present invention relates to display devices and, more particularly, to discharge lamp driving circuits for display devices.

BACKGROUND OF THE INVENTION

Cold cathode fluorescent lamps (CCFL) are widely used for backlights of large liquid crystal display (LCD) monitors and LCD TVs. FIG. 1 is a circuit diagram showing a conventional CCFL driving circuit as disclosed in Japanese Patent Application Laid-open Publication No. 1996-78180. As shown in FIG. 1, the CCFL driving circuit includes an inverter 100, a ballast capacitor 200, a sensing resistor 400, a voltage converting circuit 500, an error amplifier 600, a pulse width modulation (PWM) control circuit 700, and a discharge lamp 300. The inverter 100 converts a DC voltage of a DC power supply 110 to a high frequency voltage and supplies the high frequency voltage to the discharge lamp 300. The ballast capacitor 200 compensates for the negative impedance characteristic of the discharge lamp 300. The sensing resistor 400 senses a current flowing through the discharge lamp 300. The voltage converting circuit 500 performs a half-wave rectification on the voltage across the sensing resistor 400 to convert the voltage into a voltage of a pulse form. The error amplifier 600 generates a signal corresponding to the difference between an output signal of the voltage converting circuit 500 and a reference voltage. The PWM control circuit 700 compares an output signal of the error amplifier 600 with a reference signal of a triangle wave to output a pulse signal having a width varying with a lamp current.

In the LCD device, the periphery of a CCFL lamp is covered with a metal that is grounded, for protecting the CCFL lamp and decreasing electro-magnetic interference (EMI). However, a leakage current may flow through parasitic capacitors CPA existing between each terminal of the lamp and the metal cover 350. The amount of the leakage current may be equal to that of the lamp current. Because of the introduction of the grounded metal cover for decreasing the EMI, there may be a large difference between the current sensed by a sensing resistor 400 and the lamp current actually flowing through the discharge lamp 300.

Accordingly, there is a need for a discharge lamp driving circuit capable of detecting a lamp current accurately regardless of the metal cover introduced for decreasing the EMI. Further, there is a need for a discharge lamp driving circuit that does not operate when the lifetime of the discharge lamp is over, when there is no discharge lamp in the lamp driving system, or when the discharge lamp is not connected correctly. For designing such a discharge lamp driving circuit, there is a need to detect the voltage on a secondary side of a transformer.

SUMMARY OF THE INVENTION

Embodiments of the present invention include a discharge lamp driving circuit, which accurately detects the lamp current and the voltage on a secondary side of a transformer. Embodiments of the present invention also include a method for driving a discharge lamp, in which the lamp current and the voltage on a secondary side of a transformer are detected accurately.

According to one embodiment of the present invention, there is provided a discharge lamp driving circuit including an inverter, a ballast capacitor, a discharge lamp and a lamp current detecting circuit. The inverter converts a DC voltage into an AC voltage with high frequency to output the AC voltage to an output port based on a pulse width modulation control signal. The ballast capacitor has a terminal coupled to a first terminal of the output port of the inverter. The discharge lamp is coupled between the other terminal of the ballast capacitor and a second terminal of the output port. The lamp current detecting circuit outputs a first voltage signal and a second voltage signal according to a voltage across the ballast capacitor to generate a lamp current sensing voltage that is proportional to a lamp current flowing through the discharge lamp.

In some embodiments, the discharge pump driving circuit may further include a signal processing unit that amplifies and rectifies a difference between the first voltage signal and the second voltage signal to generate a third voltage signal and a pulse width modulation control circuit that compares the third voltage signal with a reference signal to generate the pulse width modulation control signal having a width varying with amplitude of the lamp current.

In further embodiments, the discharge pump driving circuit may include first through fourth capacitors that are implemented using a printed circuit board as a dielectric material of the first through fourth capacitors and traces arrayed on opposing sides of the printed circuit board as electrodes of the first through fourth capacitors.

According to another embodiment of the present invention, there is provided a discharge lamp driving circuit including an inverter, a ballast capacitor, a discharge lamp and a voltage detecting circuit. The inverter converts a DC voltage into an AC voltage with high frequency to output the AC voltage to an output port based on a pulse width modulation control signal. The ballast capacitor has a terminal coupled to a first terminal of the output port of the inverter. The discharge lamp is coupled between the other terminal of the ballast capacitor and a second terminal of the output port. The voltage detecting circuit is coupled between the first and second terminals of the output port of the inverter and is configured to output a first voltage signal and a second voltage signal to generate a first sensing voltage proportional to a voltage across the first and second terminals of the output port of the inverter. The voltage detecting circuit further outputs a third voltage signal and a fourth voltage signal according to a voltage across the ballast capacitor to generate a second sensing voltage that is proportional to a lamp current flowing through the discharge lamp.

According to still other embodiments of the present invention, there is provided a method for driving a discharge lamp. This method includes converting a DC voltage into an AC voltage with high frequency based on a pulse width modulation control signal, driving a discharge lamp using the converted AC voltage passed through a ballast capacitor, outputting a first voltage signal and a second voltage signal to generate a lamp current sensing voltage that is proportional to a lamp current flowing through the discharge lamp in response to a voltage across the ballast capacitor, and amplifying and rectifying a difference between the first voltage signal and the second voltage signal to generate a third voltage signal. The third voltage signal is also compared with a reference signal to generate the pulse width modulation control signal having a width varying with amplitude of the lamp current.

The method may further include generating a fourth voltage signal and a fifth voltage signal to generate a sensing voltage that is proportional to a voltage across an output port of the inverter and amplifying and rectifying a difference between the fourth voltage signal and the fifth voltage signal to generate a sixth voltage signal. The sixth voltage signal is compared with the reference signal to generate the pulse width modulation control signal having a width varying with the sensing voltage.

DETAILED DESCRIPTION OF PREFERRED EMBODIMENTS

Detailed illustrative embodiments of the present invention are disclosed herein. However, specific structural and functional details disclosed herein are merely representative for purposes of describing example embodiments of the present invention.

Figure 1:
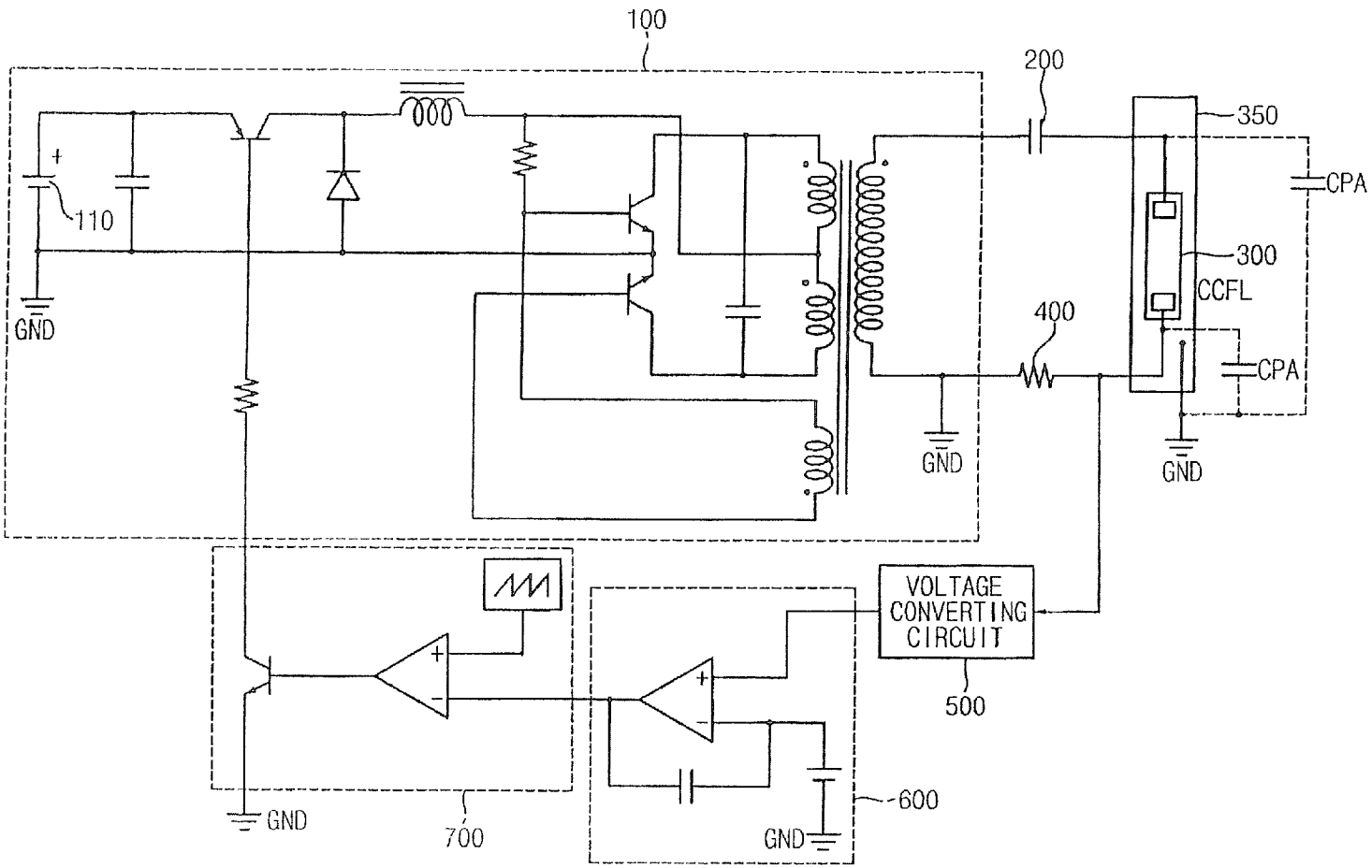
FIG. 1 (PRIOR ART)
FIG. 1 is a circuit diagram showing a conventional CCFL driving circuit.
Figure 2:
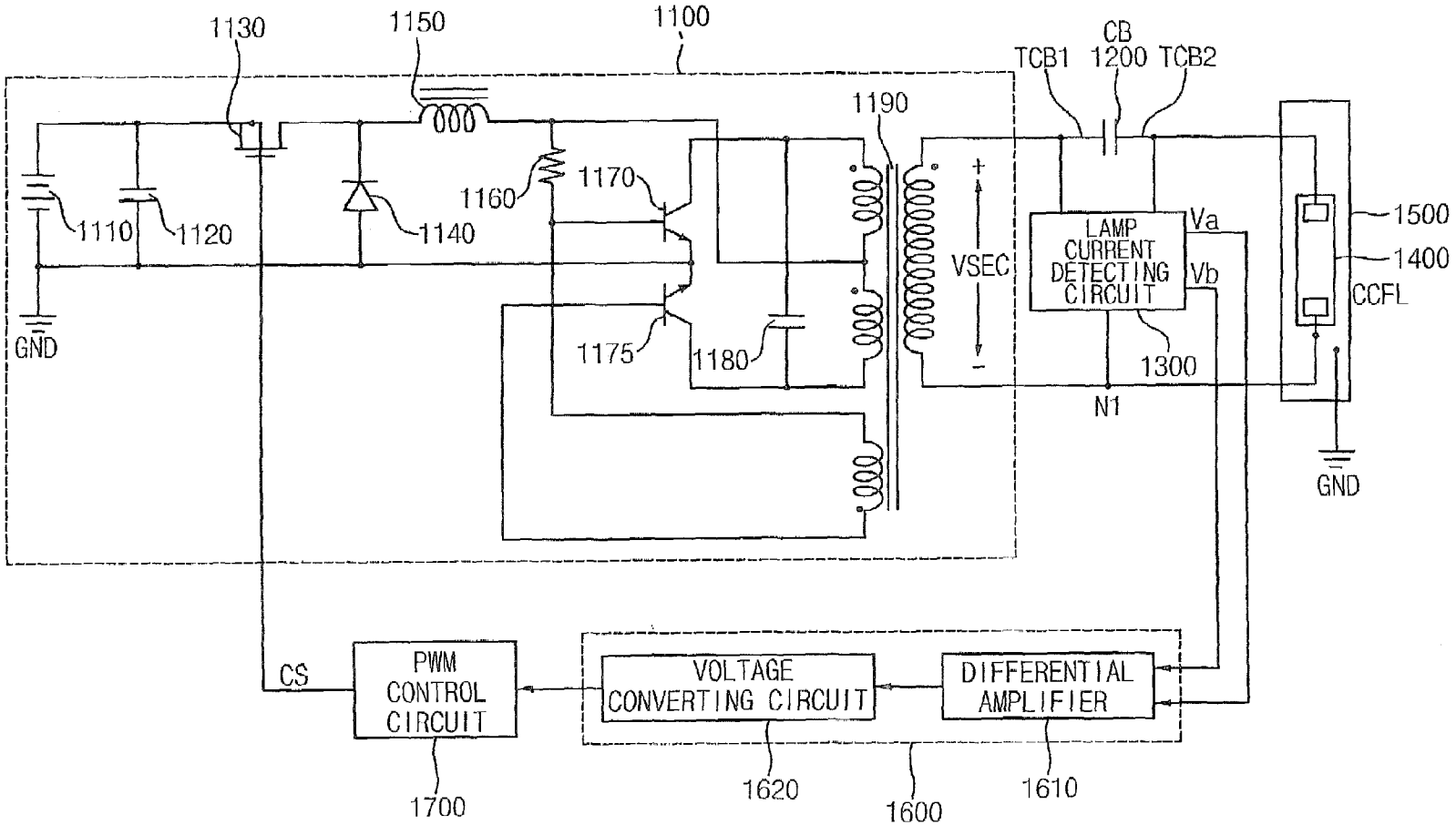
FIG. 2 is a circuit diagram showing a CCFL driving circuit according to an example embodiment of the present invention.

FIG. 2 is a circuit diagram showing a CCFL driving circuit according to an example embodiment of the present invention. Referring to FIG. 2, the CCFL driving circuit may include an inverter 1100, a ballast capacitor 1200, a lamp current detecting circuit 1300, a signal processing unit 1600, a PWM control circuit 1700, and a discharge lamp 1400. In addition, the CCFL driving circuit may further include a metal cover 1500 surrounding the discharge lamp 1400.

The inverter 1100 includes a DC power supply 1110, a capacitor 1120, a metal oxide semiconductor (MOS) transistor 1130, a diode 1140, a choke coil 1150, a resistor 1160, bipolar transistors 1170 and 1175, a capacitor 1180, and a transformer 1190. The signal processing unit 1600 includes a differential amplifier 1610 and a voltage converting circuit 1620.

The ballast capacitor (CB) 1200 is coupled between a first terminal of a secondary side of the transformer 1190 and a first terminal of the discharge lamp (CCFL) 1400. The lamp current detecting circuit 1300 is coupled to both ends TCB1 and TCB2 of the ballast capacitor 1200 and to a node N1.

Hereinafter, referring to FIG. 2, the operation of the CCFL driving circuit will be described. The inverter 1100 converts a DC voltage of the DC power supply 1110 into an AC voltage with high frequency to output the AC voltage to the discharge lamp 1400. The ballast capacitor 1200 compensates for the negative impedance characteristic of the discharge lamp 1400. The lamp current detecting circuit 1300 outputs a first voltage signal Va and a second voltage signal Vb to generate a voltage that is proportional to a lamp current flowing through the discharge lamp 1400 in response to a voltage across the ballast capacitor 1200. The signal processing unit 1600 amplifies and rectifies a difference between the first voltage signal Va and the second voltage signal Vb to detect a peak value using the differential amplifier 1610 and the voltage converting circuit 1620. The PWM control circuit 1700 compares an output signal of the signal processing unit 1600 with a reference triangular wave signal (not shown) to generate a pulse signal CS having a width directly varying with amplitude of the lamp current. The output signal CS of the PWM control circuit 1700 controls the switching of the PMOS transistor 1130. When the duty cycle of the output signal CS of the PWM control circuit 1700 increases, a current generated in the choke coil 1150 increases. In contrast, when the duty cycle of the output signal CS of the PWM control circuit 1700 decreases, the current generated in the choke coil 1150 decreases. The resistor 1160, the bipolar transistors 1170 and 1175, the capacitor 1180, and the transformer 1190 may represent a Royer-type oscillator. When the current generated in the choke coil 1150 increases, a voltage VSEC induced in the secondary side of the transformer 1190 increases. On the contrary, when the current generated in the choke coil 1150 decreases, the voltage VSEC induced in the secondary side of the transformer 1190 decreases.

In a CCFL driving device, the periphery of a CCFL lamp 1400 may be covered with a metal cover 1500 that is grounded. The metal cover 1500 decreases the electro-magnetic interference (EMI) as described with respect to the prior art. However, a leakage current may flow through parasitic capacitors (not shown) existing between each terminal of the lamp and the metal cover 1500 and the magnitude of this leakage current may be difficult to detect. The CCFL driving device according to an example embodiment of the present invention includes the lamp current detecting circuit 1300 that detects the lamp current using the voltage across the ballast capacitor (CB) 1200. Therefore, the CCFL driving device according to an example embodiment of the present invention may detect the lamp current accurately regardless of the grounded metal cover 1500.

Figure 3:
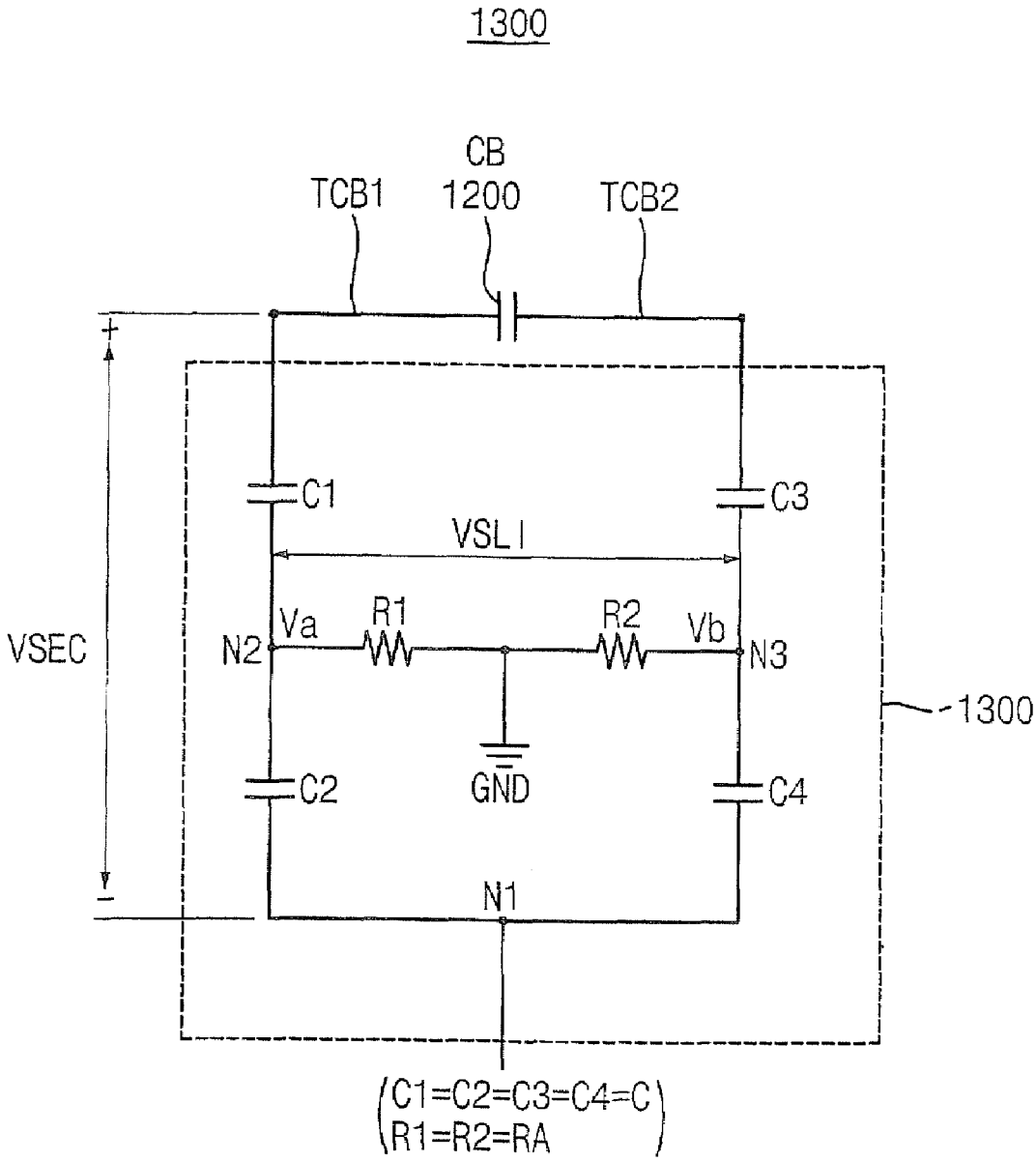
FIG. 3 is a circuit diagram showing a lamp current detecting circuit in FIG. 2.
Figure 4:
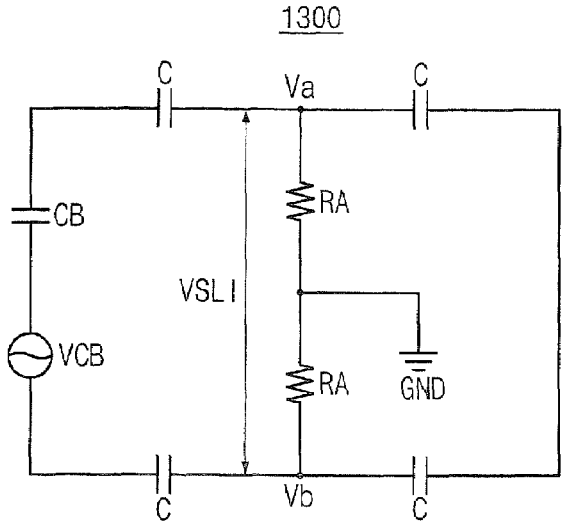
FIG. 4 and FIG. 5 are equivalent circuit diagrams showing the lamp current detecting circuit in FIG. 3.
Figure 5:
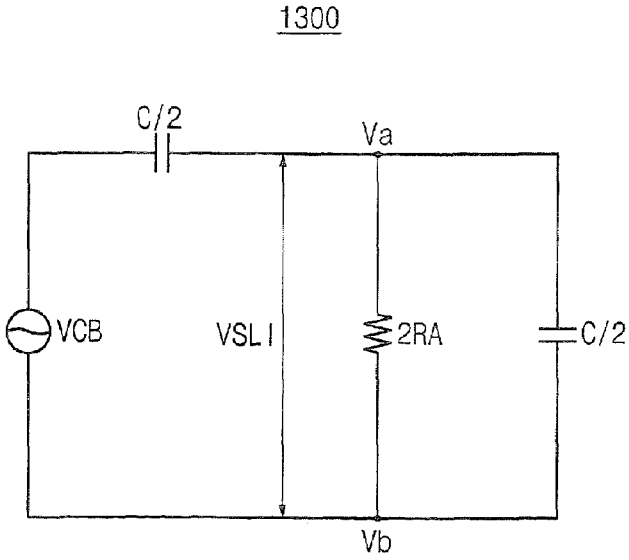

FIG. 3 is a circuit diagram showing the lamp current detecting circuit 1300 in FIG. 2. FIG. 4 and FIG. 5 are equivalent circuit diagrams illustrating the lamp current detecting circuit 1300 in FIG. 3. Referring to FIG. 3, the lamp current detecting circuit 1300 includes capacitors C1 to C4 and resistors R1 and R2. The capacitor C1 is coupled between the terminal TCB1 of the ballast capacitor (CB) 1200 and a node N2, and the capacitor C2 is coupled between the node N2 and the node N1. The capacitor C3 is coupled between the remaining terminal TCB2 of the ballast capacitor (CB) 1200 and a node N3, and the capacitor C4 is coupled between the node N3 and the node N1. The resistor R1 is coupled between the node N2 and the ground GND, and the resistor R2 is coupled between the node N3 and the ground GND. In the lamp current detecting circuit 1300, the capacitors C1 to C4 have the same capacitance (C) and the resistors R1 to R2 have the same resistance (RA). A lamp current sensing voltage VSLI is a summation of the voltage across a resistor R1 and a voltage across a resistor R2.

The ballast capacitor (CB) 1200 may be represented as a branch in which the voltage source VCB and the capacitor CB are included, as those shown in FIG. 4. Because the capacitor CB may be designed to have a large capacitance that is more than 10 times the capacitance of each of the capacitors C1 to C4, the capacitance of the capacitor CB may be ignored. Therefore, the circuit of FIG. 4 may be simplified as the circuit of FIG. 5. In FIG. 5, as the impedance of the capacitor (C/2) connected to the rightmost branch is much larger than that of the resistor (2RA) connected to the capacitor (C/2) in parallel, the capacitor (C/2) connected to the rightmost branch may be ignored.

Referring to FIG. 5, the lamp current sensing voltage VSLI may be approximately represented as the following expression 1.

$$VSLI = VCB \times \frac{2RA}{2RA + \frac{2}{j\omega C}} \quad \text{< Expression 1 >}$$

As the denominator of the expression 1 may be approximated to 2/(jωC), the expression 1 may be simplified as the following expression 2.

$$VSLI = VCB \times j\omega C \times RA \quad \text{<Expression 2>}$$

When the current flowing through the ballast capacitor (CB), i.e., the current flowing through the discharge lamp CCFL is denoted as I, VCB in the expression 2 may be represented as I/(jωCB). Accordingly, the expression 2 may be rewritten as the following expression 3.

$$VSLI = \frac{C \times RA}{CB} \times I \quad \text{< Expression 3 >}$$

Referring to expression 3, the lamp current sensing voltage VSLI is proportional to the current I flowing through the discharge lamp CCFL. Therefore, it is possible to control the inverter 1100 by detecting the lamp current sensing voltage VSLI instead of the lamp current I.

Figure 6:
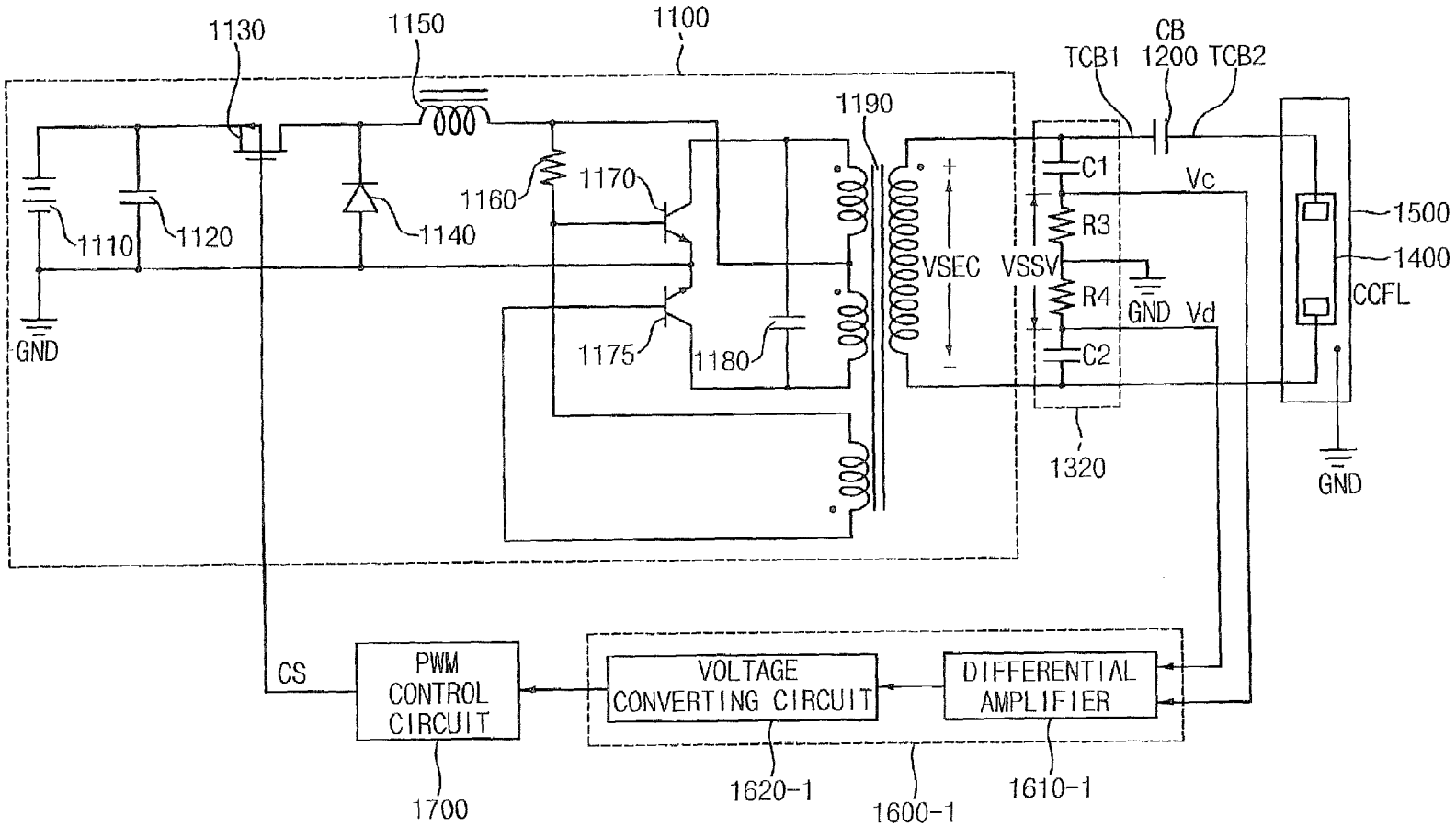
FIG. 6 is a circuit diagram showing a CCFL driving circuit according to another example embodiment of the present invention.

FIG. 6 is a circuit diagram showing a CCFL driving circuit according to another example embodiment of the present invention. Referring to FIG. 6, the CCFL driving circuit includes an inverter 1100, a ballast capacitor 1200, a voltage detecting circuit 1320, a signal processing unit 1600-1, a PWM control circuit 1700, and a discharge lamp 1400. Further, the CCFL driving circuit includes a metal cover 1500 surrounding the discharge lamp 1400. The inverter 1100 includes a DC power supply 1110, a capacitor 1120, a MOS transistor 1130, a diode 1140, a choke coil 1150, a resistor 1160, bipolar transistors 1170 and 1175, a capacitor 1180, and a transformer 1190. The signal processing unit 1600-1 includes a differential amplifier 1610-1 and a voltage converting circuit 1620-1.

The ballast capacitor (CB) 1200 is coupled between a first terminal of the secondary side of the transformer 1190 and a first terminal of the discharge lamp (CCFL) 1400. The voltage detecting circuit 1320 is coupled between the first terminal and a second terminal of the secondary side of the transformer 1190.

In the voltage detecting circuit 1320, a sensing voltage VSSV is a summed voltage of a voltage across a resistor R3 and a voltage across a resistor R4, which equals to (Vc−Vd). When the capacitors C1 and C2 have the same capacitance of C and the resistors R3 and R4 have the same resistance of RB, the sensing voltage VSSV may be represented as the following expression 4.

$$VSSV = VSEC \times \frac{2RB}{2RB + \frac{2}{j\omega C}} \quad \text{< Expression 4 >}$$

When it is assumed that RB<<1/(jωC), a first term 2RB of the denominator of the expression 4 is far smaller than a second term 2/(jωC) of the expression 4, so that the expression 4 may be simplified as the following expression 5.

$$VSSV = VSEC \times j\omega C \times RB \quad \text{<Expression 5>}$$

In the discharge lamp driving circuit of FIG. 6, by using the voltage detecting circuit 1320, the voltage VSEC on the secondary side of the transformer 1190 may be detected precisely. Therefore, the discharge lamp may stop operating when the lifetime of the lamp is over, when there is no lamp in the lamp driving system, or when the lamp is not correctly connected to the lamp driving system. Except for the voltage detecting circuit 1320, the discharge lamp driving circuit of FIG. 6 operates in a similar manner as the circuit of FIG. 3. Thus, the description of the operation of the discharge lamp driving circuit of FIG. 6 will be omitted.

Figure 7:
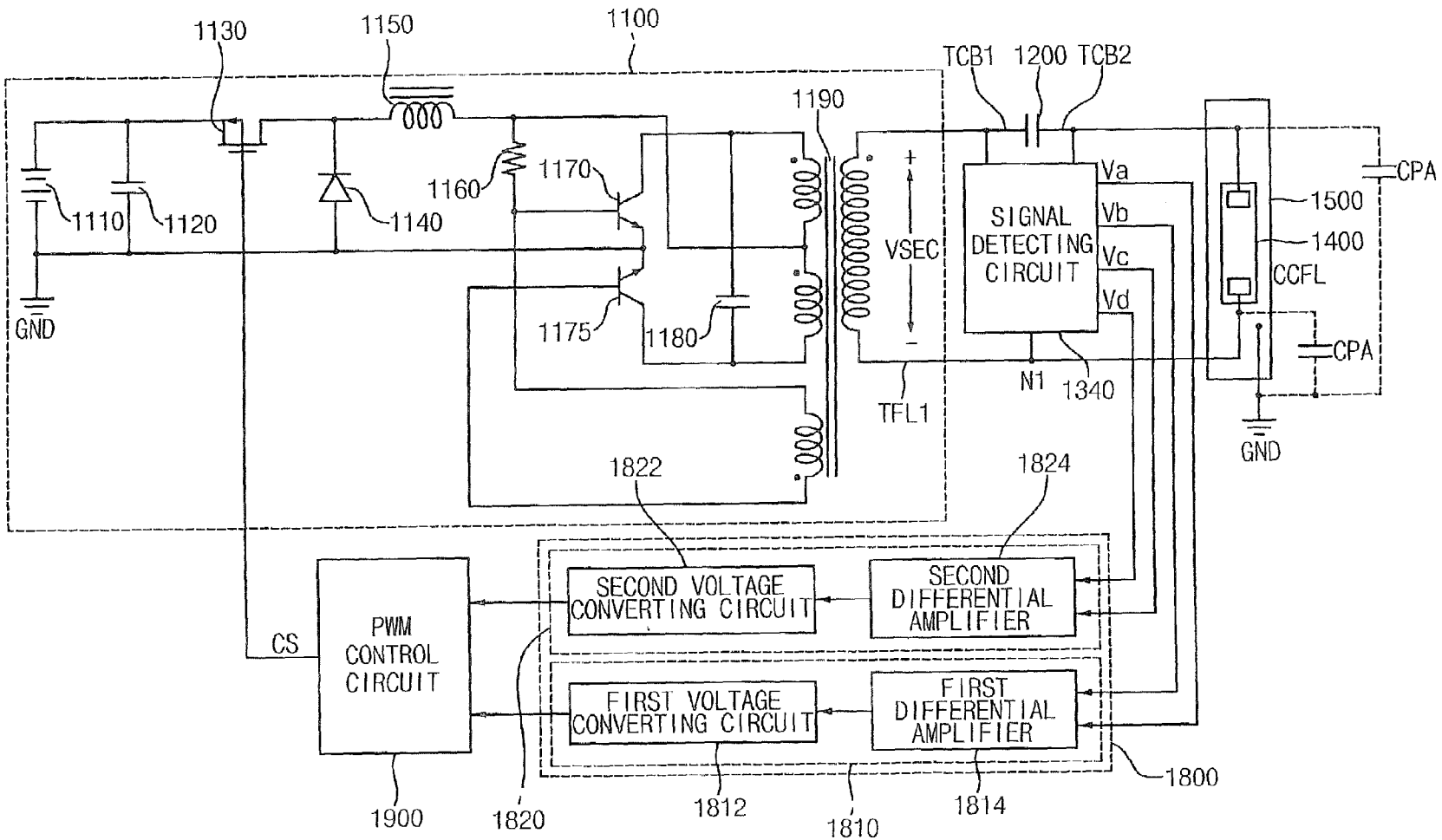
FIG. 7 is a circuit diagram showing a CCFL driving circuit according to another example embodiment of the present invention.

FIG. 7 is a circuit diagram showing a CCFL driving circuit according to another example embodiment of the present invention. The CCFL driving circuit of FIG. 7 includes a signal detecting circuit 1340 to detect both a lamp current and the voltage VSEC on the secondary side of the transformer. Referring to FIG. 7, the CCFL driving circuit includes an inverter 1100, a ballast capacitor 1200, a signal detecting circuit 1340, a signal processing unit 1800, a PWM control circuit 1900, and a discharge lamp 1400. Further, the CCFL driving circuit includes a metal cover 1500 surrounding the discharge lamp 1400. The inverter 1100 includes a DC power supply 1110, a capacitor 1120, a MOS transistor 1130, a diode 1140, a choke coil 1150, a resistor 1160, bipolar transistors 1170 and 1175, a capacitor 1180, and a transformer 1190. The signal processing unit 1800 includes a first signal processing unit 1810 and a second signal processing unit 1820. The first signal processing unit 1810 includes a first differential amplifier 1812 and a first voltage converting circuit 1814. The second signal processing unit 1820 includes a second differential amplifier 1822 and a second voltage converting circuit 1824. The ballast capacitor (CB) 1200 is coupled between a first terminal of the secondary side of the transformer 1190 and a first terminal of the discharge lamp (CCFL) 1400. The signal detecting circuit 1340 is coupled to the two terminals TCB1 and TCB2 of the ballast capacitor 1200 and to the node N1.

The inverter 1100 converts a DC voltage of the DC power supply 1110 into an AC voltage having high frequency to output the AC voltage to the discharge lamp 1400. The ballast capacitor 1200 compensates for the negative impedance characteristic of the discharge lamp 1400. The signal detecting circuit 1340 outputs a first voltage signal Va and a second voltage signal Vb to generate a voltage that is proportional to the lamp current flowing through the discharge lamp 1400 in response to a voltage across the ballast capacitor 1200. Further, the signal detecting circuit 1340 outputs a third voltage signal Vc and a fourth voltage signal Vd to generate a voltage that is proportional to the voltage VSEC on the secondary side of the transformer 1190.

The signal processing unit 1800 amplifies and rectifies a difference between the first voltage signal Va and the second voltage signal Vb to generate a fifth voltage signal, and amplifies and rectifies a difference between the third voltage signal Vc and the fourth voltage signal Vd to generate a sixth voltage signal. The pulse width modulation control circuit 1900 compares each of the fifth voltage signal and the sixth voltage signal with a reference signal to generate a pulse signal CS having a pulse width varying with amplitude of the lamp current or amplitude of the voltage VSEC on the secondary side of the transformer.

Particularly, the first signal processing unit 1810 receives the first and second voltage signals Va and Vb and amplifies and rectifies the difference therebetween to detect a peak value thereof. The second signal processing unit 1820 receives the third and fourth voltage signals Vc and Vd and amplifies and rectifies the difference therebetween to detect a peak value thereof.

The PWM control circuit 1900 compares each output signal of the first and second signal processing units 1810 and 1820 with a reference triangular wave signal (not shown) to generate the pulse signal CS having a width varying with amplitude of the lamp current.

The output signal CS of the PWM control circuit 1900 controls the switching of the PMOS transistor 1130. When the duty of the output signal CS of the PWM control circuit 1900 increases, the current generated in the choke coil 1150 increases. In contrast, when the duty of the output signal CS of the PWM control circuit 1900 decreases, the current generated in the choke coil 1150 decreases. The resistor 1160, the bipolar transistors 1170 and 1175, the capacitor 1180, and the transformer 1190 may represent a Royer-type oscillator. When the current generated in the choke coil 1150 increases, the voltage VSEC on the secondary side of the transformer 1190 increases. On the contrary, when the current generated in the choke coil 1150 decreases, the voltage VSEC on the secondary side of the transformer 1190 decreases.

Figure 8:
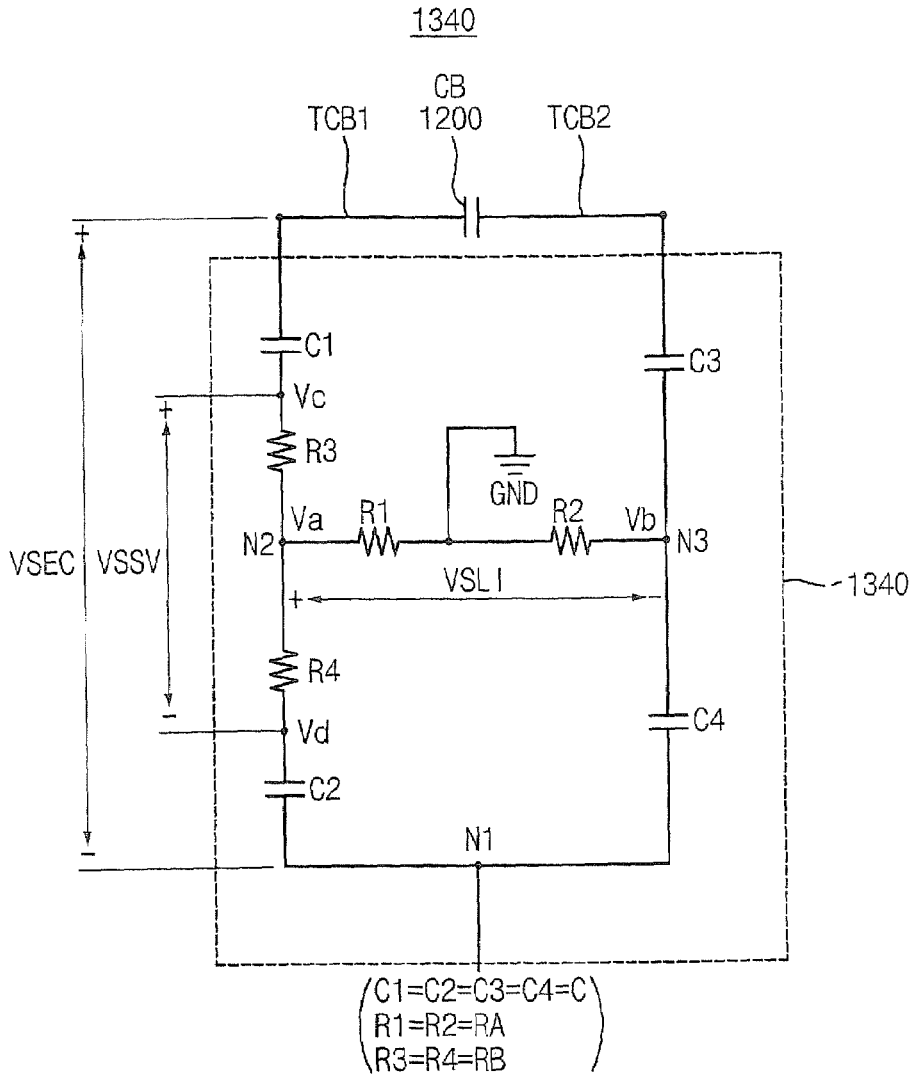
FIG. 8 is a circuit diagram showing a signal detecting circuit in FIG. 7.

FIG. 8 is a circuit diagram showing the signal detecting circuit 1340 in FIG. 7. Referring to FIG. 8, the signal detecting circuit 1340 includes capacitors C1 to C4 and resistors R1 to R4. A first terminal of the capacitor C1 is coupled to the first terminal TCB1 of the ballast capacitor (CB) 1200. The resistor R3 is coupled between a second terminal of the capacitor C1 and a node N2. A first terminal of the resistor R4 is coupled to the node N2, and the capacitor C2 is coupled between a second terminal of the resistor R4 and a node N1. The capacitor C3 is coupled between the second terminal TCB2 of the ballast capacitor (CB) 1200 and the node N3. The capacitor C4 is coupled between a node N3 and the node N1. The resistor R1 is coupled between the node N2 and the ground GND, and the resistor R2 is coupled between the node N3 and the ground GND. The capacitors C1 to C4 may have the same capacitance. Further, the resistors R1 and R2 may have the same resistance, and the resistors R3 and R4 may have the same resistance.

When the current through the secondary side of the transformer 1190 is a sine wave, and when each of the capacitors C1 to C4 has the capacitance C that is C<<CB, each of the resistors R1 and R2 has the resistance (RA) that is RA<<1/(jωC) and each of the resistors R3 and R4 has the resistance (RB) that is RB<<1/(jωC), the circuit of FIG. 8 may be represented as the circuit of FIG. 4. Further, when each of the capacitors C1 to C4 in FIG. 8 is designed to have a capacitance less than one tenth of the capacitance of the capacitor CB, the circuit of FIG. 4 may be represented as the circuit of FIG. 5. In FIG. 5, as the impedance of the capacitor (C/2) connected to the rightmost branch is much larger than that of the resistor (2RA) that is connected in parallel to the capacitor (C/2), the capacitor (C/2) connected to the rightmost branch may be ignored. Referring to FIG. 5, the lamp current sensing voltage VSLI may be represented as the above expressions 1 to 3.

A sensing voltage VSSV, which may be represented as Vc−Vd, is used to detect the voltage VSEC on the secondary side of the transformer 1190. The sensing voltage VSSV may be calculated in a similar manner as in an example embodiment of the present invention of FIG. 6. Namely, the voltage VSEC on the secondary side of the transformer 1190 may be detected using the sensing voltage VSSV calculated by the above expression 5. Thus, in an example embodiment of FIG. 7, both the lamp current and the voltage VSEC on the secondary side of the transformer may be detected using the signal detecting circuit 1340 in the CCFL driving circuit.

Figure 9:
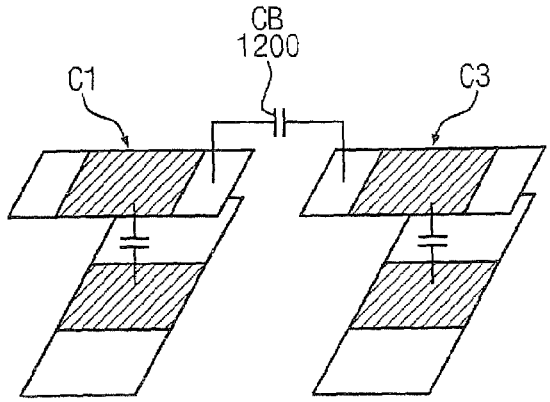
FIG. 9 is a diagram illustrating capacitors configuring the signal detecting circuit in the CCFL driving circuit of FIG. 7, implemented using both sides of a PCB.

FIG. 9 is a diagram illustrating capacitors within the signal detecting circuit 1340 in the CCFL driving circuit of FIG. 7, implemented using opposing sides of a PCB. In FIG. 9, only two capacitors C1 and C3, coupled to the ballast capacitor CB, are illustrated for convenience's sake. It is desirable that the capacitors C1 to C4 in the signal detecting circuit 1340 have a small capacitance and resistance to high voltage. The capacitor having such a property is hard to obtain and expensive to buy, resulting in increased cost of the CCFL inverter. Accordingly, in an example embodiment, an overlapped portion (shadowed area in FIG. 9) of two traces arrayed orthogonally to each other on opposing sides of the printed circuit board (PCB) may be used as any one of the capacitors C1 to C4 in the signal detecting circuit 1340. A Metal lead having a predetermined width may be used for the trace that is arrayed orthogonally to another trace on opposing sides of the PCB.

Figure 10:
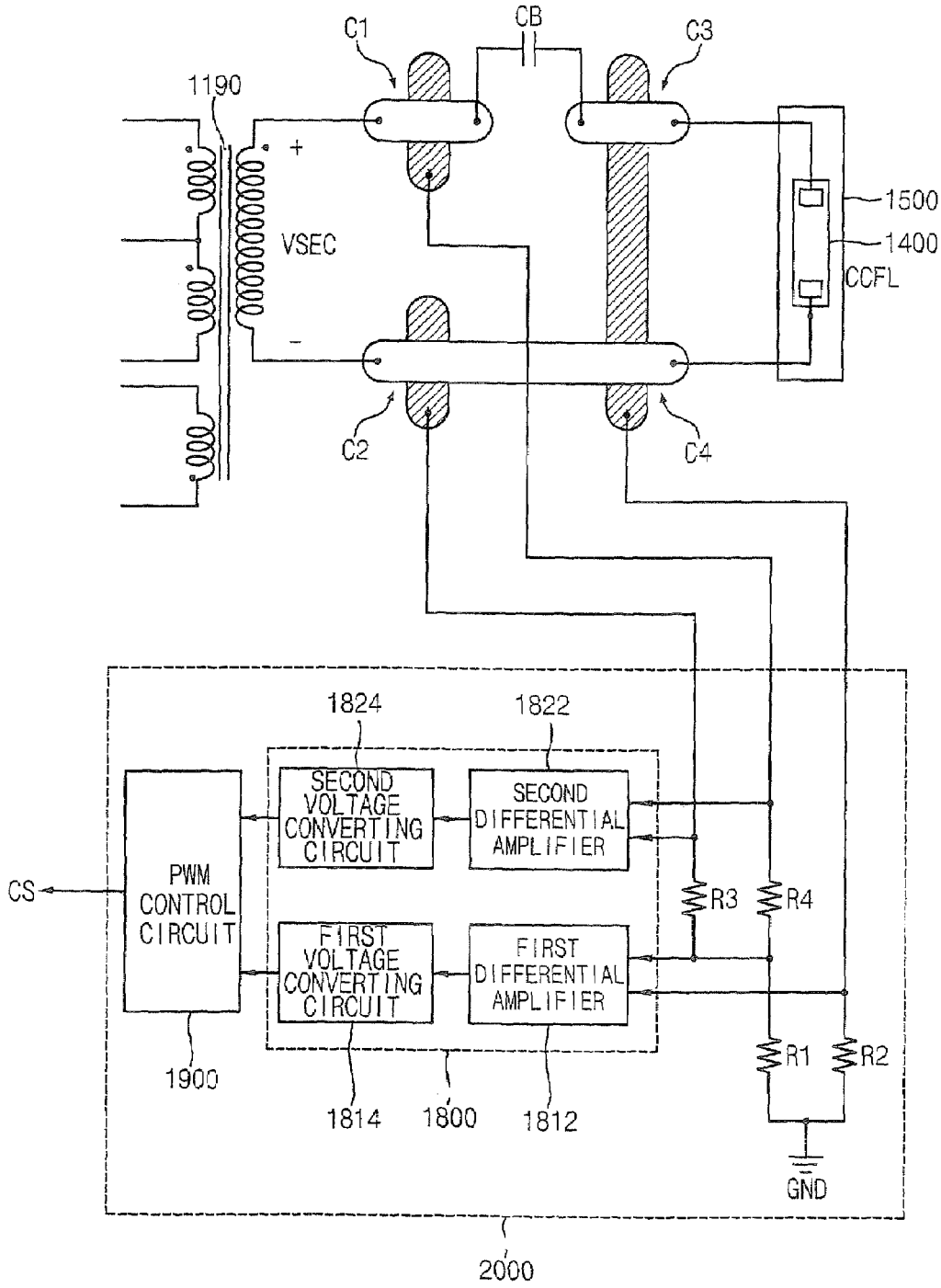
FIG. 10 is a circuit diagram illustrating resistors configuring the signal detecting circuit in the CCFL driving circuit of FIG. 7, implemented in a semiconductor integrated circuit.

FIG. 10 is a circuit diagram illustrating resistors configuring the signal detecting circuit 1340 in the CCFL driving circuit of FIG. 7, implemented in a semiconductor integrated circuit. Referring to FIG. 10, the capacitors C1 to C4 in the signal detecting circuit 1340 in the CCFL driving circuit is a PCB capacitor using tow traces arrayed orthogonally to each other on opposing sides of the PCB. The resistors R1 to R4 in the signal detecting circuit 1340, the signal processing unit 1800, and the PWM control circuit 1900 may be integrated in a semiconductor chip 2000.

As mentioned above, the discharge lamp driving circuit according to the example embodiments of the present invention may accurately detect the lamp current and the voltage on the secondary side of the transformer. In addition, in the discharge lamp driving circuit according to the example embodiments of the present invention, the designing cost may be lowered by using the traces on opposite sides of the PCB in implementing a capacitor having very small capacitance. Further, according to the example embodiments of the present invention, most of the inverter control circuit including the signal detecting circuit may be implemented in one semiconductor integrated circuit.

While the example embodiments of the present invention and its advantages have been described in detail, it should be understood that various changes, substitutions and alterations can be made herein without departing from the scope of the invention as defined by appended claims.

What is claimed is:

1. A discharge lamp driving circuit, comprising:

an inverter configured to convert a DC voltage into an AC voltage with high frequency to output the AC voltage to an output port based on a pulse width modulation control signal;

a ballast capacitor having a first terminal coupled to a first terminal of the output port of the inverter;

a discharge lamp coupled between a second terminal of the ballast capacitor and a second terminal of the output port of the inverter; and a voltage detecting circuit, coupled between the first and second terminals of the output port of the inverter, configured to output a first voltage signal and a second voltage signal to generate a first sensing voltage proportional to a voltage across the first and second terminals of the output port of the inverter.

2. A discharge lamp driving circuit, comprising:

an inverter configured to convert a DC voltage into an AC voltage with high frequency to output the AC voltage to an output port based on a pulse width modulation control signal;

a ballast capacitor having a first terminal coupled to a first terminal of the output port of the inverter;

a discharge lamp coupled between a second terminal of the ballast capacitor and a second terminal of the output port of the inverter; and a voltage detecting circuit, coupled between the first and second terminals of the output port of the inverter, configured to output a first voltage signal and a second voltage signal to generate a first sensing voltage proportional to a voltage across the first and second terminals of the output port of the inverter, said voltage detecting circuit comprising:

a first capacitor having a first terminal commonly coupled to the first terminal of the output port of the inverter and the first terminal of the ballast capacitor;

a first resistor coupled between a second terminal of the first capacitor and the ground;

a second capacitor having a first terminal coupled to the second terminal of the output port of the inverter; and a second resistor coupled between a second terminal of the second capacitor and the ground.

3. The discharge lamp driving circuit of claim 2, wherein the first voltage signal is outputted at a node where the first capacitor and the first resistor are connected, and the second voltage signal is outputted at a node where the second capacitor and the second resistor are connected, and wherein the difference between the first voltage signal and the second voltage signal corresponds to the first sensing voltage.

4. The discharge lamp driving circuit of claim 2, wherein the first through fourth capacitors are implemented using a printed circuit board as a dielectric material of the first through fourth capacitors and traces arrayed on opposing sides of the printed circuit board as electrodes of the first through fourth capacitors.

5. The discharge lamp driving circuit of claim 2, wherein the first capacitor and the second capacitor have the same capacitance with each other and the first resistor and the second resistor have the same resistance with each other.

6. The discharge lamp driving circuit of claim 5, wherein each of the first through fourth capacitors has much less capacitance than a capacitance of the ballast capacitor.

7. The discharge lamp driving circuit of claim 6, wherein the first sensing voltage is expressed as:

$$VSSV = VSEC \times j\omega C \times RB$$

wherein VSSV denotes the first sensing voltage, VSEC denotes the voltage across the first and second terminals of the output port of the inverter, C denotes the capacitance of each of the first capacitor and the second capacitor, and RB denotes the resistance of each of the first resistor and the second resistor.

8. A discharge lamp driving circuit, comprising:

an inverter configured to convert a DC voltage into an AC voltage with high frequency to output the AC voltage to an output port based on a pulse width modulation control signal;

a ballast capacitor having a first terminal coupled to a first terminal of the output port of the inverter;

a discharge lamp coupled between a second terminal of the ballast capacitor and a second terminal of the output port of the inverter;

a voltage detecting circuit, coupled between the first and second terminals of the output port of the inverter, configured to output a first voltage signal and a second voltage signal to generate a first sensing voltage proportional to a voltage across the first and second terminals of the output port of the inverter;

a signal processing unit configured to amplify and rectify a difference between the first voltage signal and the second voltage signal to generate a third voltage signal; and a pulse width modulation control circuit configured to compare the third voltage signal with a reference signal to generate the pulse width modulation control signal having a width varying with the first sensing voltage.

9. The discharge lamp driving circuit of claim 8, wherein the signal processing unit includes:

a differential amplifier configured to amplify the difference between the first voltage signal and the second voltage signal; and a voltage converting circuit configured to rectify an output signal of the differential amplifier to detect a peak value of the output signal of the differential amplifier.

10. A discharge lamp driving circuit, comprising:

an inverter configured to convert a DC voltage into an AC voltage with high frequency to output the AC voltage to an output port based on a pulse width modulation control signal;

a ballast capacitor having a first terminal coupled to a first terminal of the output port of the inverter;

a discharge lamp coupled between a second terminal of the ballast capacitor and a second terminal of the output port of the inverter; and a voltage detecting circuit, coupled between the first and second terminals of the output port of the inverter, configured to output a first voltage signal and a second voltage signal to generate a first sensing voltage proportional to a voltage across the first and second terminals of the output port of the inverter;

wherein the voltage detecting circuit further outputs a third voltage signal and a fourth voltage signal according to a voltage across the ballast capacitor to generate a second sensing voltage that is proportional to a lamp current flowing through the discharge lamp.

11. The discharge lamp driving circuit of claim 10, wherein the voltage detecting circuit includes:

a first capacitor having a first terminal coupled to the first terminal of the ballast capacitor;

a first resistor coupled between a second terminal of the first capacitor and a first node;

a second capacitor having a first terminal coupled to the second terminal of the output port of the inverter;

a second resistor coupled between the first node and a second terminal of the second capacitor;

a third capacitor coupled between the second terminal of the ballast capacitor and a second node;

a fourth capacitor coupled between the second node and the second terminal of the output port of the inverter;

a third resistor coupled between the first node and the ground; and a fourth resistor coupled between the second node and the ground.

12. The discharge lamp driving circuit of claim 11, wherein a voltage at the first node is the first voltage signal, and a voltage at the second node is the second voltage signal, and a difference between the first voltage signal and the second voltage signal corresponds to the second sensing voltage.

13. The discharge lamp driving circuit of claim 11, wherein the first through fourth capacitors have the same capacitance with each other, the first resistor and the second resistor have the same resistance with each other, and the third resistor and the fourth resistor have the same resistance with each other.

14. The discharge lamp driving circuit of claim 13, wherein each of the first through fourth capacitors has much less capacitance than a capacitance of the ballast capacitor.

15. The discharge lamp driving circuit of claim 14, wherein the second sensing voltage is expressed as:

$$VSLI=((C\times RA)/CB)\times I$$

wherein VSLI denotes the second sensing voltage, CB denotes the capacitance of the ballast capacitor, C denotes the capacitance of each of the first through fourth capacitors, RA denotes the resistance of each of the first resistor and the second resistor, RB denotes the resistance of each of the third resistor and the fourth resistor, and I denotes the lamp current.

16. The discharge lamp driving circuit of claim 11, further comprising:

a signal processing unit configured to amplify and rectify a difference between the first voltage signal and the second voltage signal to generate a fifth voltage signal, and configured to amplify and rectify a difference between the third voltage signal and the fourth voltage signal to generate a sixth voltage signal; and a pulse width modulation control circuit configured to compare each of the fifth voltage signal and the sixth voltage signal with a reference signal to generate the pulse width modulation control signal having a width varying with one of the first sensing voltage and the second sensing voltage.

17. The discharge lamp driving circuit of claim 16, wherein the first through fourth resistors are integrated in one semiconductor chip together with the signal processing unit and the pulse width modulation control circuit.

18. The discharge lamp driving circuit of claim 16, wherein the signal processing unit includes:

a first differential amplifier configured to amplify the difference between the first voltage signal and the second voltage signal;

a first voltage converting circuit configured to rectify an output signal of the first differential amplifier to detect a peak value of the output signal of the first differential amplifier;

a second differential amplifier configured to amplify the difference between the third voltage signal and the fourth voltage signal; and a second voltage converting circuit configured to rectify an output signal of the second differential amplifier to detect a peak value of the output signal of the second differential amplifier.

19. A method of driving a discharge lamp, comprising:

converting a DC voltage into an AC voltage with high frequency based on a pulse width modulation control signal;

driving the discharge lamp using the converted AC voltage passed through the ballast capacitor;

outputting a first voltage signal and a second voltage signal according to a voltage across the ballast capacitor to generate a lamp current sensing voltage that is proportional to a lamp current flowing through the discharge lamp;

generating a third voltage signal by amplifying and rectifying a difference between the first voltage signal and the second voltage signal; and comparing the third voltage signal with a reference signal to generate the pulse width modulation control signal having a width varying with amplitude of the lamp current.

20. The method of claim 19, wherein the discharge lamp is a cold cathode fluorescent lamp.

21. The method of claim 19, further comprising:

generating a fourth voltage signal and a fifth voltage signal to generate a sensing voltage that is proportional to a voltage across an output port of the inverter;

generating a sixth voltage signal by amplifying and rectifying a difference between the fourth voltage signal and the fifth voltage signal; and comparing the sixth voltage signal with the reference signal to generate the pulse width modulation control signal having a width varying with the sensing voltage.

* * * * *